US005961402A

United States Patent [19]

Spiegel

[11] Patent Number: 5,961,402

[45] Date of Patent: Oct. 5, 1999

[54] MOLD FOR TEMPORARY FOOTBALL KICKING TEE

[76] Inventor: H. Jay Spiegel, P.O. Box 444, Mount Vernon, Va. 22121

[21] Appl. No.: 08/862,377

[22] Filed: May 23, 1997

[51] Int. Cl.[6] ..... A63B 67/00

[52] U.S. Cl. ..... 473/420

[58] Field of Search ..... 473/420, 387; 99/439, 472

[56] References Cited

U.S. PATENT DOCUMENTS

| | | | |
|---|---|---|---|
| D. 291,714 | 9/1987 | Spiegel | 473/420 |
| D. 305,448 | 1/1990 | Spiegel | 473/420 |
| D. 330,149 | 10/1992 | Weimer | D7/672 |
| D. 372,062 | 7/1996 | Spiegel | 473/420 |
| D. 383,816 | 9/1997 | Spiegel | 473/420 |
| D. 383,817 | 9/1997 | Spiegel | 473/420 |
| 683,244 | 9/1901 | Boda . | |
| 702,078 | 6/1902 | Stockder . | |
| 2,546,656 | 3/1951 | Smith | 99/439 |
| 3,225,714 | 12/1965 | Gaskell | 99/439 |
| 3,671,008 | 6/1972 | Villalba | 99/439 |
| 4,655,453 | 4/1987 | Spiegel et al. | 473/420 |
| 4,657,252 | 4/1987 | Spiegel | 473/420 |

*Primary Examiner*—Sebastiano Passaniti
*Attorney, Agent, or Firm*—H. Jay Spiegel

[57] ABSTRACT

A mold is made of a thin-walled material and allows the user to mold a temporary football kicking tee out of a loose material such as, for example, wet sand or mud. In use, the material is placed into the mold, packed tightly in the mold, and then the mold is inverted and placed on a ground surface, whereupon the mold is removed leaving behind a temporary football kicking tee. The inventive mold may be used at a sandy beach or in any other desired location. The user can kick a football from the temporary tee formed by the mold without fear that he or she will be injured if the tee is accidentally struck, since the loose material of the temporary tee will give way upon application of a small force.

11 Claims, 5 Drawing Sheets

MOLD FOR TEMPORARY FOOTBALL KICKING TEE

BACKGROUND OF THE INVENTION

The present invention relates to a mold for temporary football kicking tee. In the prior art, football kicking tees are well known and are made in various shapes and sizes. Applicant is the holder of United States Patents disclosing and claiming kicking tees, including U.S. Pat. Nos. 4,655,453; 4,657,252 and D291,714. Other applications are currently pending.

Applicant is unaware of any mold ever devised to allow the user to mold a temporary football kicking tee for instructional purposes and to allow the user to learn how to kick a football without fear of striking the tee and hurting the user's foot.

Most football kicking tees now on the market other than those marketed by Applicant rely upon a flat surface and two or more upstanding prongs to support a football thereon. In such tees, the kicker often strikes one or more of the prongs or the tee body itself causing a stinging sensation or more serious injury. The tees marketed by Applicant under the Registered Trademarks "TOE-TAL" and "GROUND ZERO" solve this problem by providing kicking tees devoid of prongs and relying upon surface contact about the tip of the football to support the football within a ball-receiving recess. With no upstanding prongs, it is virtually impossible to properly kick a football and strike the tee as well. The present invention is designed to appeal to a young kicker, early in his or her career, who wishes to learn place kicking technique without any fear of injury from striking the kicking tee. Other users could include beach-goers.

SUMMARY OF THE INVENTION

The present invention relates to a mold for temporary football kicking tee. The present invention includes the following interrelated objects, aspects and features:

(1) In a first aspect, the inventive tee is made of a thin-walled material such as, for example, vacuum-formed plastic. The outer surfaces of the body of the mold may generally resemble a kicking tee or may be of any desired shape. Of course, it is the inner surfaces of the mold that are crucial in causing the molding of a temporary football kicking tee.

(2) The inner surfaces of the mold are preferably sized, shaped and configured with two adjacent protrusions, one of which is at least partially shaped in conformance with the tip of an oblate, spheroidal football, which protrusion connects at one side thereof with the second protrusion that is designed to provide an adjacent recess in the temporary football tee allowing the tip of the football to spin out of the tee when it is kicked by the user.

(3) The peripheral walls of the inner surfaces of the mold are designed to provide a finished kicking tee that is non-threatening to the user. In particular, these walls will provide a temporary football kicking tee having ramp-like surfaces at the rear thereof extending upwardly to a top termination closely adjacent the rear walls of the ball-receiving recess formed by the mold.

(4) If desired, the mold may be provided with accessories allowing the elevation of the tee to be adjusted. Thus, one or more ring-like structures may be provided that can be attached on the bottom, open edge of the mold to extend the edge downwardly a sufficient distance to allow the mold to create a temporary football kicking tee that elevates the ball higher.

As such, it is a first object of the present invention to provide a mold for temporary football kicking tee.

It is a further object of the present invention to provide such a device including inner surfaces designed with at least one protrusion at least partially resembling the tip of an oblate, spheroidal football.

It is a still further object of the present invention to provide such a device wherein loose material such as sand or mud may be placed within the inner surfaces of the mold to mold a temporary football kicking tee.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
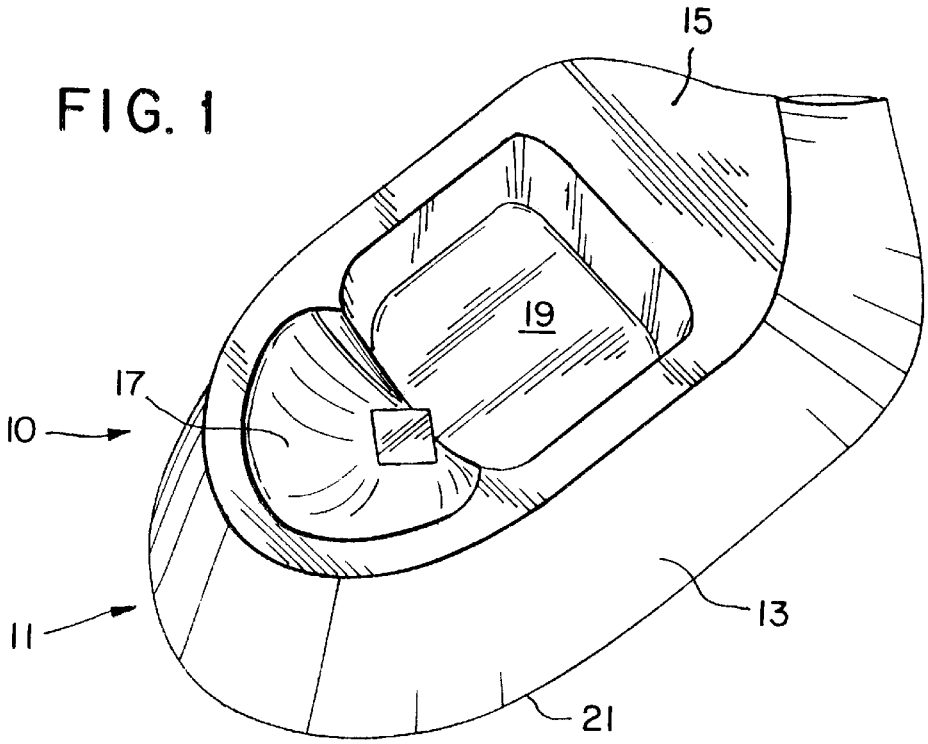
FIG. 1 shows a top, right rear perspective view of the present invention.
Figure 2:
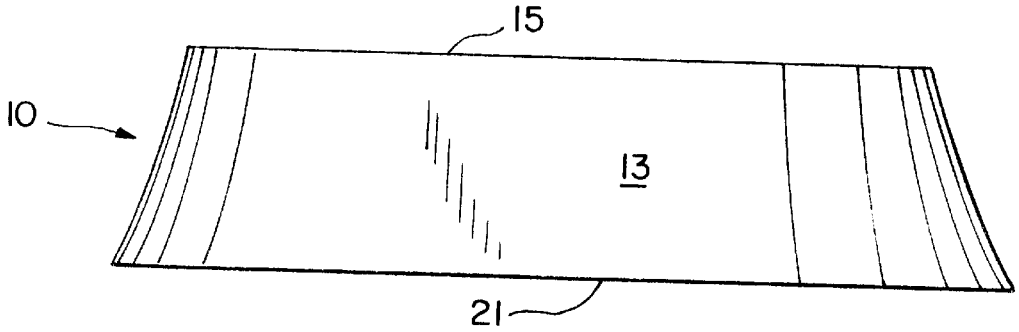
FIG. 2 shows a side view of the present invention of which the other side is identical.
Figure 3:
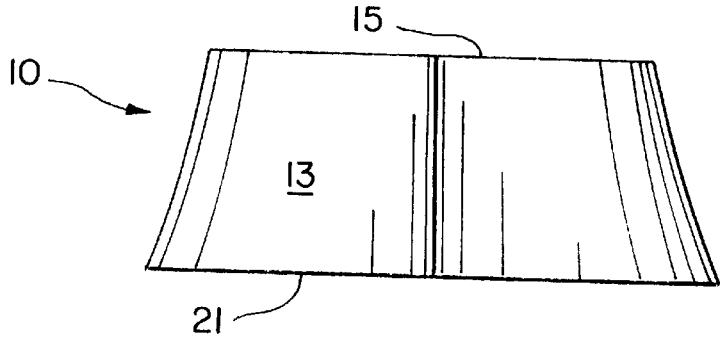
FIG. 3 shows a front view of the present invention.
Figure 4:
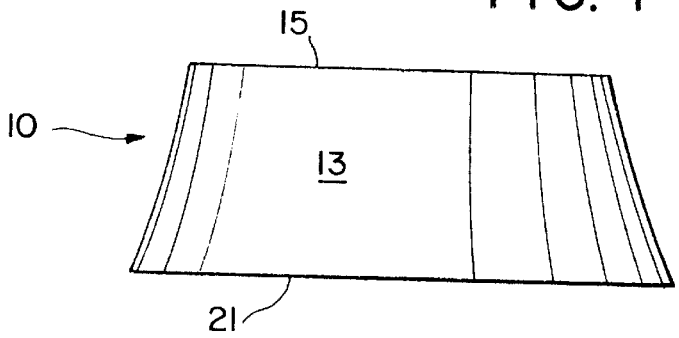
FIG. 4 shows a rear view of the present invention.
Figure 5:
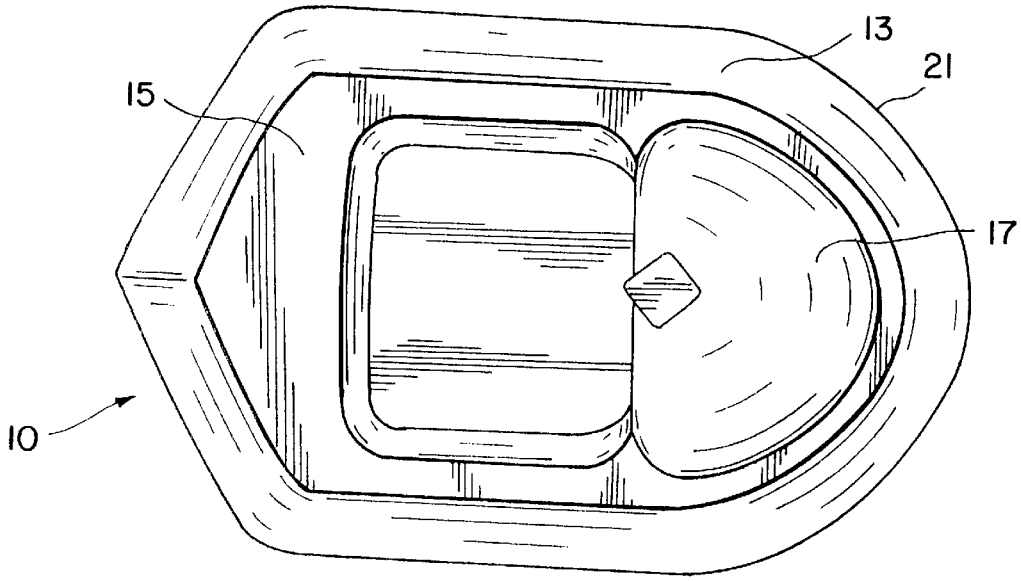
FIG. 5 shows a top view of the present invention.

With reference, first, to FIGS. 1–6, a first embodiment of a mold in accordance with the teachings of the present invention is generally designated by the reference numeral 10 and is seen to include outer surfaces 11 including a peripheral wall 13, top surface 15, recesses 17 and 19, and a bottom edge or termination wall 21 that is generally oval-shaped.

Figure 6:
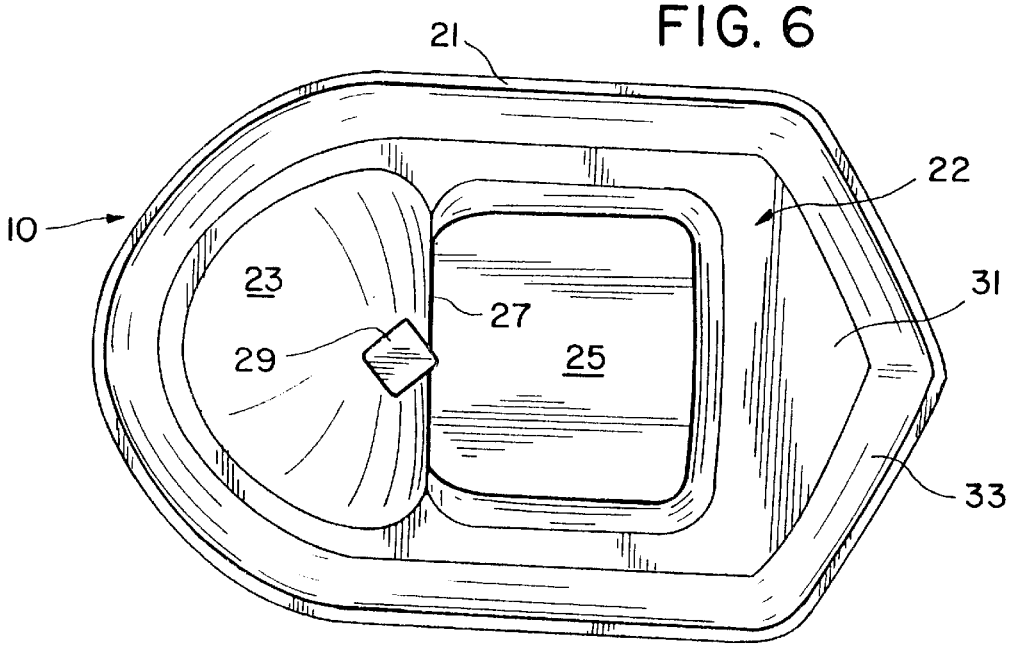
FIG. 6 shows a bottom view of the present invention.

With particular reference to FIG. 6, the inventive mold 10 defines a mold cavity including a first protrusion 23 shaped at least partially in conformance with the tip of an oblate, spheroidal football, and a second protrusion 25 adjacent thereto and interconnected at an interface 27. The protrusion 23 is defined, at its highest point, by a diamond-shaped surface 29 that corresponds to the absolute termination tip of an oblate, spheroidal football. The second protrusion 25 is preferably generally rectangular cubic.

The mold cavity, generally designated by the reference numeral 22, includes an innermost, flat surface 31 as well as side walls 33 that, with the surface 31, will define the periphery of a finished temporary football kicking tee. The mold cavity is specifically configured so that it may be filled with loose material, the material being compacted, then the body is inverted and placed on a ground surface and linearly removed from the material to leave a temporary football kicking tee on the ground surface.

Figure 7:
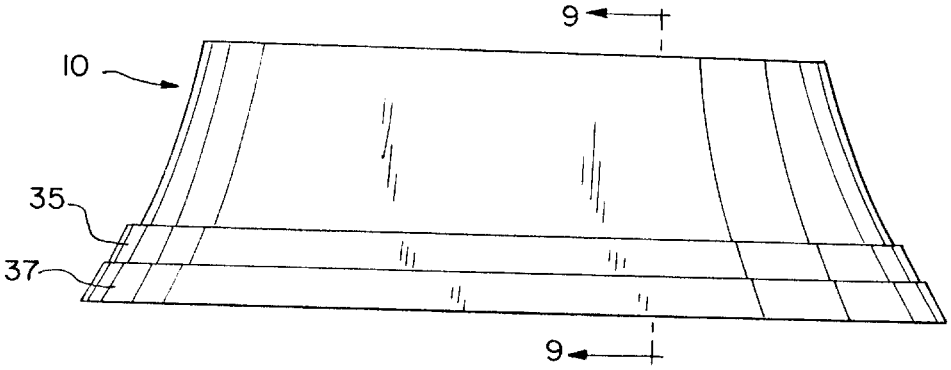
FIG. 7 shows a side view of the present invention showing accessory mold rings attached that increase the height of a finished temporary football kicking tee.
Figure 8:
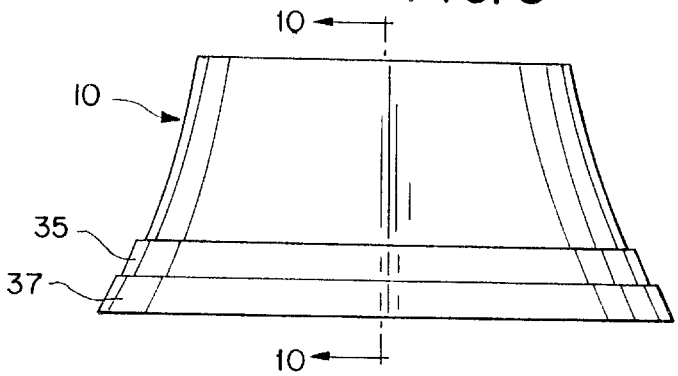
FIG. 8 shows a rear view of the present invention showing accessory mold rings attached that increase the height of a finished temporary football kicking tee.
Figure 9:
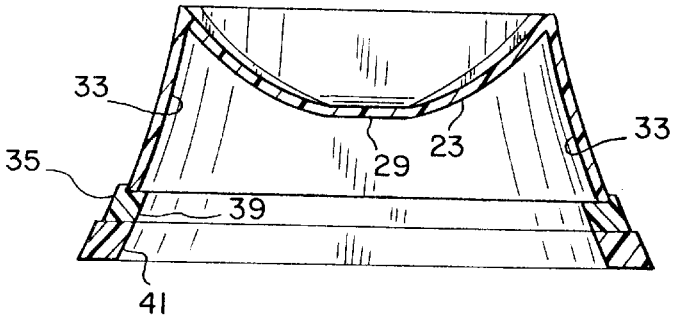
FIG. 9 shows a cross-sectional view along the line 9—9 of FIG. 7.
Figure 10:
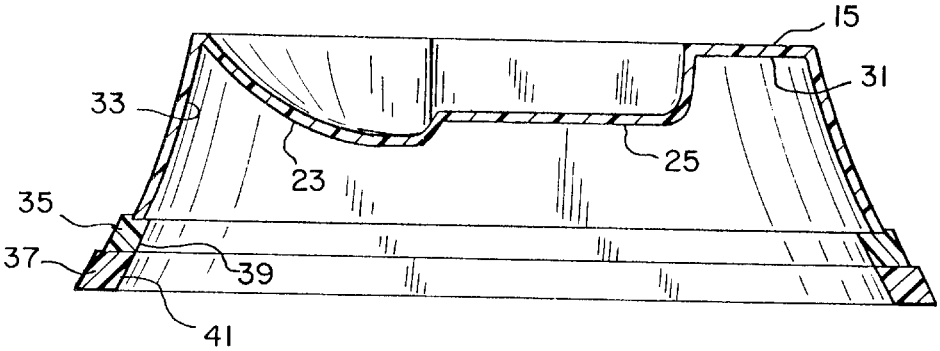
FIG. 10 shows a cross-sectional view along the line 10—10 of FIG. 8.

FIGS. 7 and 8 show accessories 35 and 37 that may be added to the mold 10 to increase the vertical dimension of a temporary football kicking tee made using the inventive mold 10. FIGS. 9 and 10 better illustrate the accessories 35 and 37 that consist of rings having respective inner surfaces 39 and 41 that continue the walls 33 in a smooth fashion. One or both of the accessories 35 and 37 may be employed depending upon the desired height dimension for the finished temporary football kicking tee.

Figure 11:
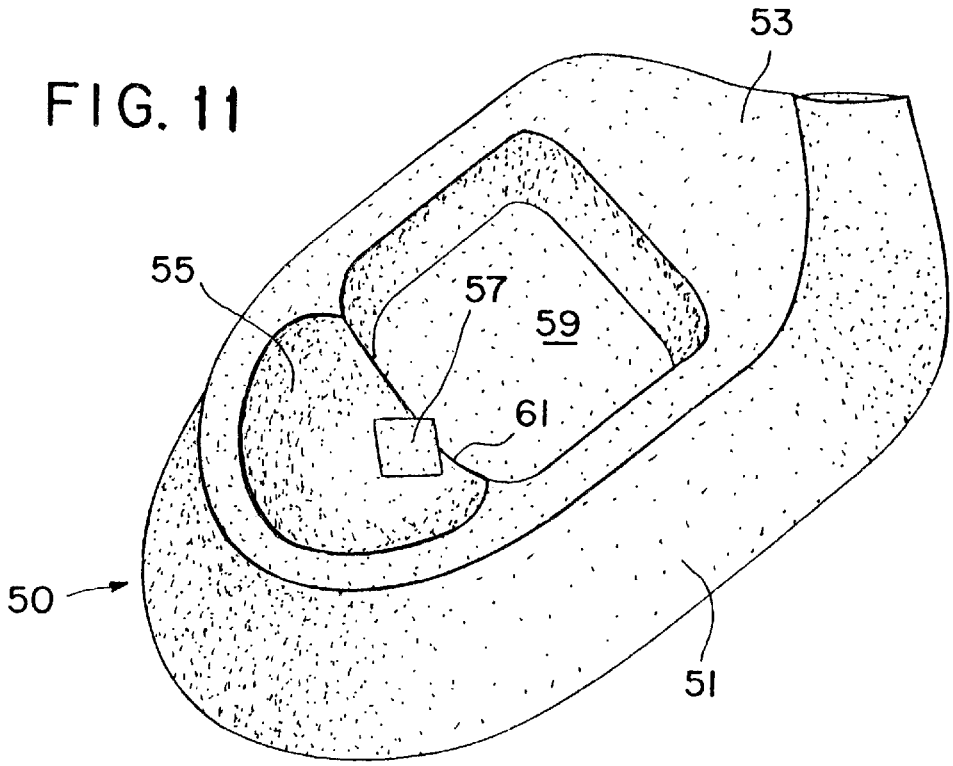
FIGS. 11, 12 and 13 show perspective, side and front views, respectively, of a temporary tee made of wet sand using the mold of FIGS. 1–6.
Figure 12:
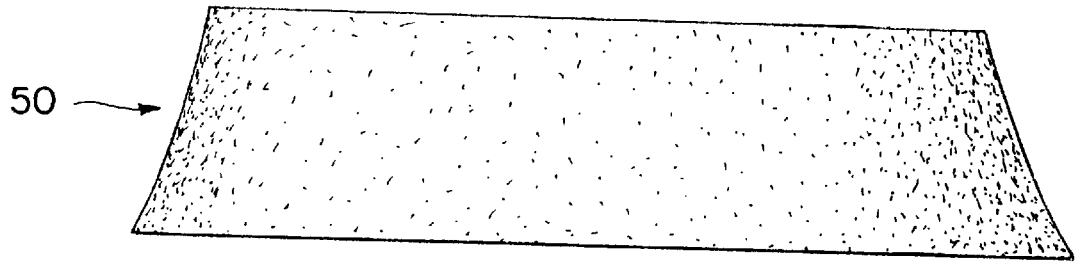
Figure 13:
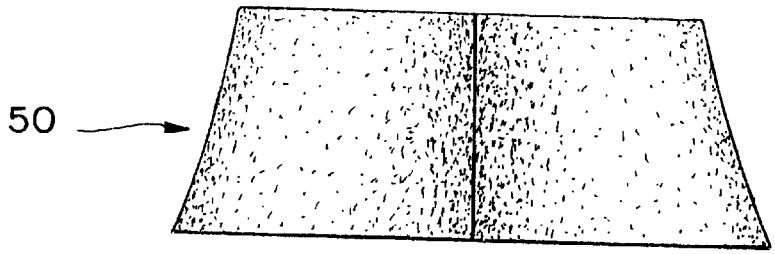

FIGS. 11, 12 and 13 show a temporary football kicking tee made of wet sand using the mold 10 without the accessories 35 and 37. As is clear from the figures, the temporary football kicking tee 50 includes peripheral walls 51 corresponding to the walls 33 of the mold 10, a top surface 53 corresponding to the surface 31 of the mold 10, a first recess 55 corresponding to the protrusion 23 and having a diamond-shaped bottom portion 57 formed by the surface 29, and a second recess 59 formed by the protrusion 25 of the mold and having an interface 61 between the first and second recesses 55 and 59, respectively, corresponding to the interface 27 in the mold 10.

Figure 14:
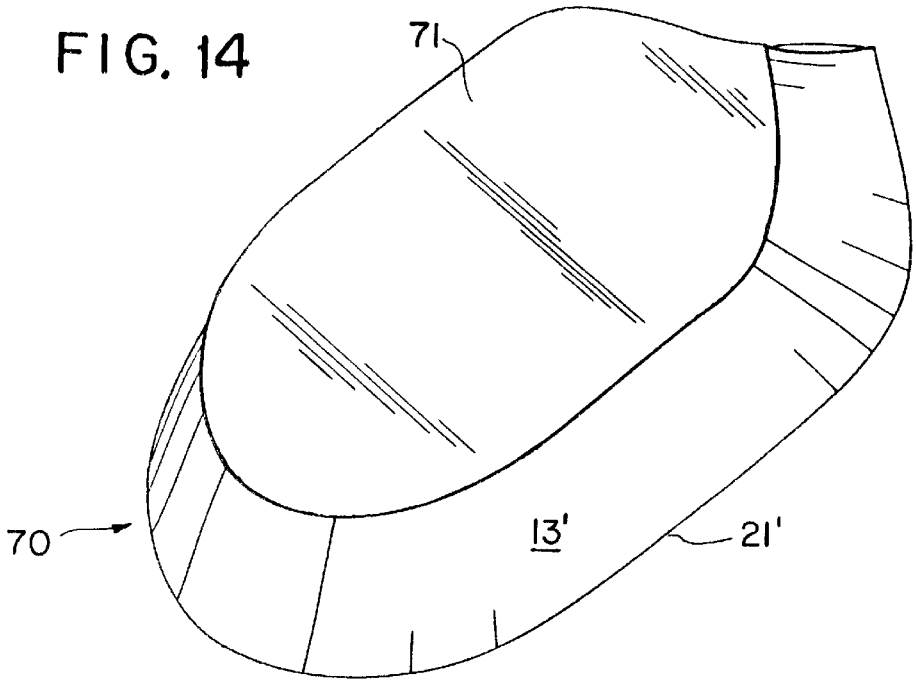
FIGS. 14, 15 and 16 show perspective, side and front views, respectively, of a modified mold having a flat top surface, the other views of this embodiment being identical to the views of FIGS. 4, 5 and 6, respectively.
Figure 15:
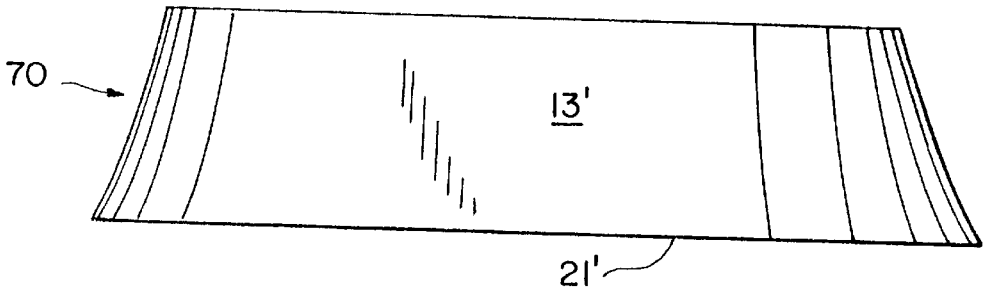
Figure 16:
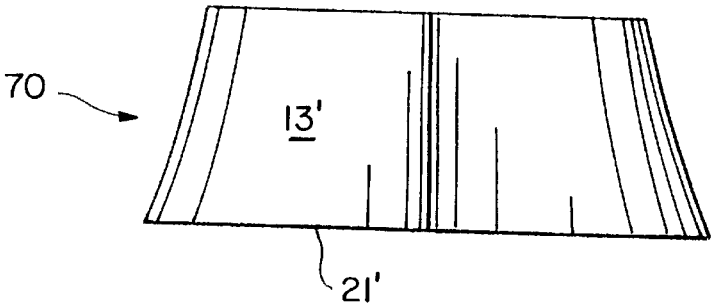

FIGS. 14–16 show a second embodiment of mold in accordance with the teachings of the present invention that is generally designated by the reference numeral 70 and where like structures as compared to the embodiment of FIGS. 1–6 are shown using like primed reference numerals. The mold 70 includes a peripheral wall 13' as well as a bottom edge 21'. In the mold 70, the top surface 71 is made flat as compared to the surfaces 15, 17 and 19 in the mold 10 which mimic the protrusions 23 and 25 and the inner surfaces 31 of the mold 10.

Thus, in comparing the embodiment of FIGS. 1–6 with the embodiment of FIGS. 14–16, in the former embodiment, the entirety of the mold 10 is made of thin walls throughout, perhaps, in a vacuum-forming process. In contrast, while the peripheral walls 13' of the mold 70 are also thin in nature in the manner depicted in FIGS. 9 and 10, the top portion of the mold 70 has a varying thickness defined by protrusions thereof in the inner surfaces thereof that directly correspond to the shape and configuration of the protrusions 23 and 25 of the mold 10. The mold 70, when used, results in the creation of a temporary football kicking tee directly corresponding to the tee 50 illustrated in FIGS. 11–13.

In the embodiments of the present invention, the inventive molds are preferably made of any suitable plastic material. The mold illustrated in FIGS. 1–10 may be cheaply made in a vacuum-forming process. Due to the thicknesses underneath the surface 71 of the mold 70, the mold 70 is more effectively manufactured by injection molding. Of course, if desired, the mold of FIGS. 1–10 may also be made through an injection molding process.

As such, an invention has been disclosed in terms of preferred embodiments thereof which fulfill each and every one of the objects of the invention as set forth hereinabove and provide a new and useful mold for temporary football kicking tee of great novelty and utility. of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A mold for a temporary football kicking tee, comprising:

a) a thin-walled body defining an internal cavity bounded by a termination wall defining a peripheral opening;

b) said cavity having a protrusion therein shaped at least partially in conformance with a tip of an oblate, spheroidal ball;

c) said cavity being sized and configured such that a loose material comprising wet sand or mud may be filled therein through said opening, said body may be inverted so that said opening faces a ground surface and said wall engages said ground surface, whereupon said body may be linearly lifted from said material, said material forming a temporary football kicking tee having a recess corresponding to said protrusion.

2. The mold of claim 1, wherein said wall is generally oval-shaped.

3. The mold of claim 1, wherein said protrusion comprises a first protrusion, said body further including a second protrusion connected to said first protrusion at an interface.

4. The mold of claim 3, wherein said second protrusion is generally rectangular cubic.

5. The mold of claim 1, wherein said cavity includes internal walls that converge in a direction away from said termination wall.

6. The mold of claim 1, further including a flat wall adjacent said protrusion.

7. A method of molding a temporary football kicking tee including the steps of:

a) providing a mold including:

i) a thin-walled body defining an internal cavity bounded by a termination wall defining a peripheral opening;

ii) said cavity having a protrusion therein shaped at least partially in conformance with a tip of an oblate, spheroidal ball;

b) filling a loose material into said cavity;

c) compacting said material within said cavity;

d) inverting said body and placing said body on a ground surface; and e) linearly removing said body from said material;

f) said material forming a temporary football kicking tee.

8. The method of claim 7, wherein said wall is generally oval-shaped.

9. The method of claim 7, wherein said protrusion comprises a first protrusion, said body further including a second protrusion connected to said first protrusion at an interface.

10. The method of claim 7, wherein said cavity includes internal walls that converge in a direction away from said termination wall.

11. The method of claim 7, wherein said filling step comprises the step of filling sand or mud in said cavity.

* * * * *